US007153109B2

(12) United States Patent
Cho et al.

(10) Patent No.: US 7,153,109 B2
(45) **Date of Patent: *Dec. 26, 2006**

(54) VARIABLE CAPACITY ROTARY COMPRESSOR

(75) Inventors: Sung Hea Cho, Suwon-Si (KR); Seung Kap Lee, Suwon-Si (KR); Chun Mo Sung, Hwasung-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 179 days.

This patent is subject to a terminal disclaimer.

(21) Appl. No.: 10/922,943

(22) Filed: Aug. 23, 2004

(65) Prior Publication Data

US 2005/0112008 A1 May 26, 2005

(30) Foreign Application Priority Data

Nov. 25, 2003 (KR) ..... 10-2003-0084231

(51) Int. Cl.
*F01C 20/18* (2006.01)

(52) U.S. Cl. ..... 418/29; 418/60; 417/218; 417/221; 417/410.3

(58) Field of Classification Search ..... 418/29, 418/57, 60, 69; 417/218, 221, 223, 287, 417/298, 410.3

See application file for complete search history.

(56) References Cited

U.S. PATENT DOCUMENTS 2,761,616 A * 9/1956 Newton ..... 417/281
3,191,854 A * 6/1965 Lowler et al. ..... 418/85
3,961,862 A * 6/1976 Edstrom et al. ..... 417/282
5,871,342 A 2/1999 Harte et al.
6,796,773 B1 * 9/2004 Choi et al. ..... 417/218
6,935,853 B1 * 8/2005 Lee et al. ..... 418/60
2005/0019189 A1 * 1/2005 Lee et al. ..... 418/60
2005/0063849 A1 * 3/2005 Cho et al. ..... 418/23
2005/0069422 A1 * 3/2005 Lee et al. ..... 417/274
2005/0112010 A1 * 5/2005 Cho et al. ..... 418/6

OTHER PUBLICATIONS

U.S. Appl. No. 10/936,641, filed Sep. 9, 2004, Cho et al, Samsung Electronics Co, Ltd.
U.S. Appl. No. 10/936,640, filed Sep. 9, 2004, Lee et al, Samsung Electronics Co, Ltd.

* cited by examiner

*Primary Examiner*—Hoang Nguyen
(74) *Attorney, Agent, or Firm*—Staas & Halsey LLP

(57) ABSTRACT

A variable capacity rotary compressor includes a hermetic casing, a housing installed in the hermetic casing to define therein first and second compression chambers having different capacities, and a compressing unit placed in the first and second compression chambers and operated to execute a compression operation in either the first or second compression chamber according to a rotating direction of a rotating shaft which drives the compressing unit. The compressor further includes a suction path controller, a high-pressure pipe, and a high-pressure path controller. The suction path controller controls a refrigerant suction path so that a refrigerant is delivered into an inlet port of the first or second compression chamber where the compression operation is executed. The high-pressure pipe couples an outlet side of the compressor to the suction path controller. The high-pressure path controller is provided at a predetermined portion of the suction path controller, and controls a high-pressure path so that the high-pressure pipe communicates with the inlet port of the first or second compression chamber where an idle operation is executed, according to variance of temperature when the refrigerant suction path is controlled by the suction path controller.

21 Claims, 10 Drawing Sheets

VARIABLE CAPACITY ROTARY COMPRESSOR

CROSS-REFERENCE TO RELATED APPLICATIONS

This application claims the benefit of Korean Patent Application No. 2003-84231, filed Nov. 25, 2003 in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor which has a high-pressure path controller to allow an internal pressure of a compression chamber where an idle operation is executed, to be equal to an internal pressure of a hermetic casing.

2. Description of the Related Art

Recently, a variable capacity compressor has been increasingly used in refrigeration systems, such as air conditioners or refrigerators, to vary the cooling capacity as desired to accomplish an optimum cooling operation and saving energy.

In Korea Patent Application No. 2002-61462 there is disclosed a variable capacity rotary compressor which was filed by the inventor of the present invention. In the Korea Patent Application No. 2002-61462, the compressor is designed to execute a compression operation in either of two compression chambers having different capacities.

The variable capacity rotary compressor includes two compression chambers and two eccentric units. The two eccentric units are respectively installed in each of the compression chambers, and are operated so that one of two rollers respectively placed in each of the compression chambers, is eccentric from a rotating shaft to execute a compression operation while a remaining one of the rollers is released from eccentricity from the rotating shaft to prevent the compression operation from being executed, according to a rotating direction of the rotating shaft. Each of the eccentric units includes an eccentric cam and an eccentric bush. The eccentric cams of the eccentric units are respectively provided on an outer surface of the rotating shaft to be placed in each of the compression chambers. The eccentric bushes are rotatably fitted over the eccentric cams, respectively. Further, the rollers are respectively fitted over each of the eccentric bushes. A locking pin causes one of the eccentric bushes to be eccentric from the rotating shaft while making a remaining one of the eccentric bushes to be released from eccentricity from the rotating shaft, when the rotating shaft rotates. Two vanes are respectively installed in each of the compression chambers to reciprocate in a radial direction. The compression chambers are respectively partitioned into an intake space and a discharging space by each of the vanes.

The variable capacity rotary compressor is constructed such that the compression operation is executed in one of the two compression chambers having different capacities while the idle operation is executed in a remaining one of the compression chambers, by the eccentric units. Thus, the compression capacity of the compressor is varied by only changing the rotating direction of the rotating shaft.

SUMMARY OF THE INVENTION

Accordingly, an aspect of the present invention provides a variable capacity rotary compressor which has a pressure controller to allow an internal pressure of a compression chamber where an idle operation is executed, to be equal to a pressure of an outlet side of the compressor to prevent a vane from pressing an outer surface of a roller and to prevent oil from flowing into the compression chamber, therefore minimizing a rotating resistance.

A further aspect of the invention provides a conventional variable capacity rotary compressor in which an internal pressure of a compression chamber where the idle operation is executed, is not lower than an internal pressure of the hermetic casing, which is a pressure of an outlet side of the compressor, thus preventing a vane from rotating while pressing an outer surface of a roller which executes an idle rotation, and preventing oil from flowing into a compression chamber where the idle operation is executed, therefore preventing a rotating resistance.

The above and/or other aspects are achieved by a variable capacity rotary compressor including a hermetic casing, a housing installed in the hermetic casing to define therein first and second compression chambers having different capacities, and a compressing unit placed in the first and second compression chambers and operated to execute a compression operation in either the first or second compression chamber according to a rotating direction of a rotating shaft which drives the compressing unit. The variable capacity rotary compressor further includes a suction path controller, a high-pressure pipe, and a high-pressure path controller. The suction path controller controls a refrigerant suction path so that a refrigerant is delivered into an inlet port of the first or second compression chamber where the compression operation is executed. The high-pressure pipe couples an outlet side of the compressor to the suction path controller. The high-pressure path controller is provided at a predetermined portion of the suction path controller, and controls a high-pressure path so that the high-pressure pipe communicates with the inlet of the first or second compression chamber where an idle operation is executed, according to variance of temperature when the refrigerant suction path is controlled by the suction path controller.

According to another aspect of the invention, the suction path controller may include a hollow body, a valve seat, and first and second valves. The hollow body may have an inlet connected to a refrigerant inlet pipe, and first and second outlets formed on the hollow body at opposite ends of the hollow body to be spaced apart from the inlet of the hollow body. The first and second outlets may be respectively connected to the corresponding inlet ports of the first and second compression chambers. The valve seat may be provided in the hollow body to communicate with the inlet of the hollow body of the suction path controller. The first and second valves may be provided at both sides in the hollow body to axially reciprocate in the hollow body to open either of opposite ends of the valve seat, and may be connected to each other by a connection rod.

In another aspect of this embodiment, the high-pressure pipe may include first and second pipes which are respectively connected to opposite ends of the hollow body to communicate with the opposite ends of the hollow body. The high-pressure path controller may include first and second bimetal valves which are respectively mounted to outlets of the first and second pipes. In this case, the first or second bimetal valve may open the outlet of the first or second pipe which has a higher temperature, when the refrigerant suction path is changed by a reciprocating motion of the first and second valves.

In yet another aspect of this embodiment, each of the first and second bimetal valves may include first and second metal plates to have different thermal strains. Each of the first and second bimetal valves may have at a center thereof a dome-shaped valve controller to open the high-pressure path, and may be fabricated to have a shape of saw teeth on a circumference thereof to allow a flow of the refrigerant.

In still another aspect of this embodiment, the variable capacity rotary compressor may further include first and second plugs respectively provided on the opposite ends of the hollow body to close the opposite ends of the hollow body. In this case, the first pipe may be connected to the first plug, and the second pipe may be connected to the second plug. The first and second bimetal valves may be respectively housed in the high-pressure path defined in each of the first and second plugs.

In yet another aspect of this embodiment, each of the first and second valves may include a thin valve plate to come into contact with the valve seat, and a supporter to support the thin valve plate.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
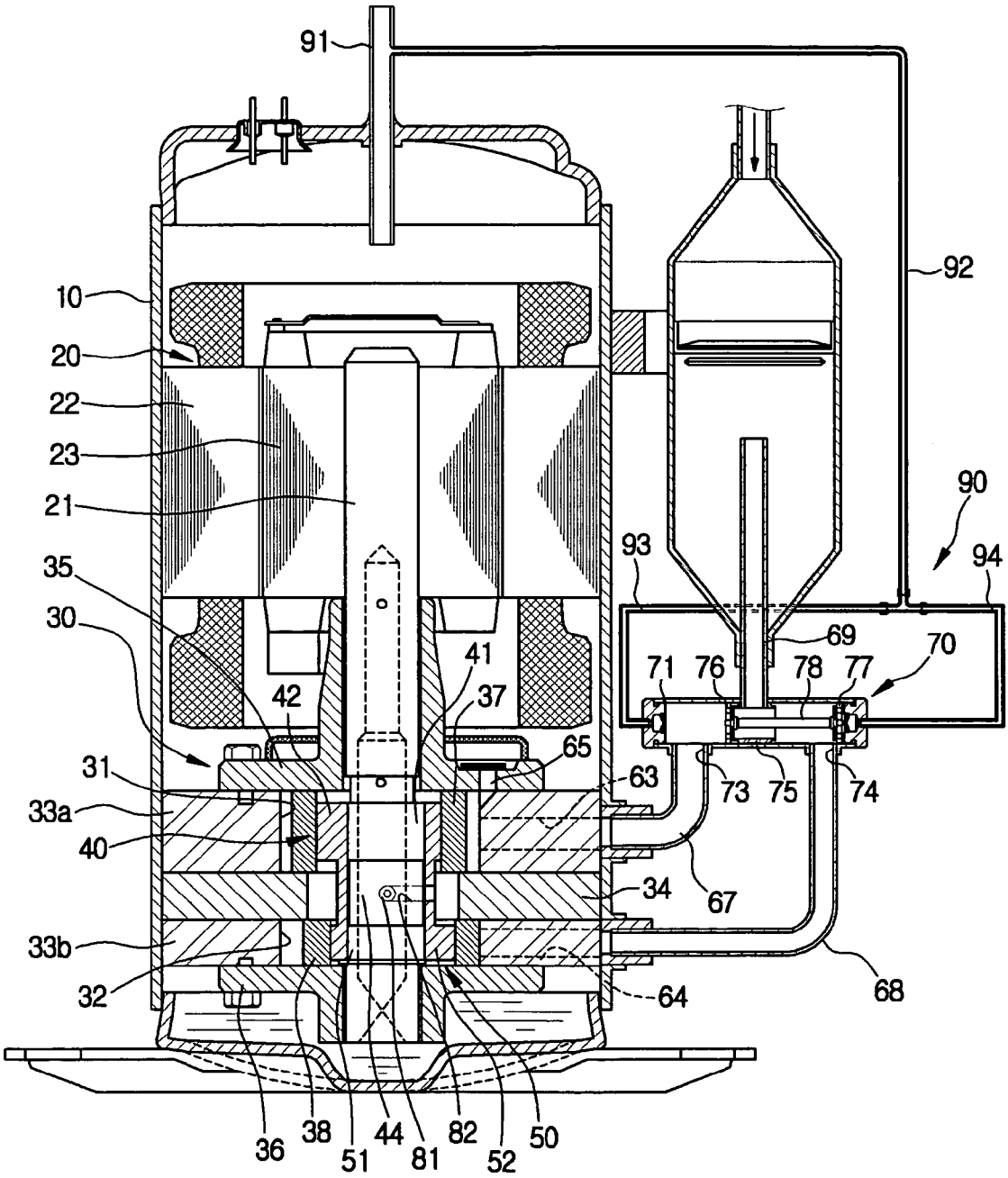
FIG. 1 is a sectional view of a variable capacity rotary compressor, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIG. 1, a variable capacity rotary compressor according to the present invention includes a hermetic casing 10, with a drive unit 20 and a compressing unit 30 being installed in the hermetic casing 10. The drive unit 20 is installed on an upper portion of the hermetic casing 10 to generate a rotating force. The compressing unit 30 is installed on a lower portion of the hermetic casing 10 to be connected to the drive unit 20 through a rotating shaft 21. The drive unit 20 includes a cylindrical stator 22 and a rotor 23. The stator 22 is mounted to an inner surface of the casing 10. The rotor 23 is rotatably and concentrically set in the stator 22, and is mounted to the rotating shaft 21. The drive unit 20 rotates the rotating shaft 21 in opposite directions.

The compressing unit 30 includes a housing. Cylindrical first and second compression chambers 31 and 32, having different capacities, are provided on upper and lower portions of the housing, respectively. The housing includes a first housing 33*a* to define the first compression chamber 31 therein, and a second housing 33*b* to define the second compression chamber 32 therein. The housing also has upper and lower flanges 35 and 36 to rotatably support the rotating shaft 21. The upper flange 35 is mounted to an upper surface of the first housing 33*a* to close an upper portion of the first compression chamber 31, and the lower flange 36 is mounted to a lower surface of the second housing 33*b* to close a lower portion of the second compression chamber 32. A partition 34 is interposed between the first and second housing 33*a* and 33*b* so that the first and second compression chambers 31 and 32 are partitioned from each other.

As shown in FIGS. 1 to 4, the rotating shaft 21, installed in the first and second compression chambers 31 and 32, is provided with first and second eccentric units 40 and 50 which are arranged on upper and lower portions of the rotating shaft 21, respectively. First and second rollers 37 and 38 are rotatably fitted over the first and second eccentric units 40 and 50, respectively. A first vane 61 is installed between an inlet port 63 and an outlet port 65 of the first compression chamber 31, and reciprocates in a radial direction while being in contact with an outer surface of the first roller 37 to execute a compression operation. Further, a second vane 62 is installed between an inlet 64 and an outlet 66 of the second compression chamber 32, and reciprocates in the radial direction while being in contact with an outer surface of the second roller 38 to execute the compression operation. The first and second vanes 61 and 62 are biased by first and second vane springs 61*a* and 62*a*, respectively. Further, the inlet and outlet 63 and 65 of the first compression chamber 31 are arranged on opposite sides of the first vane 61. Similarly, the inlet and outlets 64 and 66 of the second compression chamber 32 are arranged on opposite sides of the second vane 62. Although not shown in the drawings in detail, the outlets 65 and 66 communicate with an interior of the hermetic casing 10 via a path defined in the housing.

Figure 2:
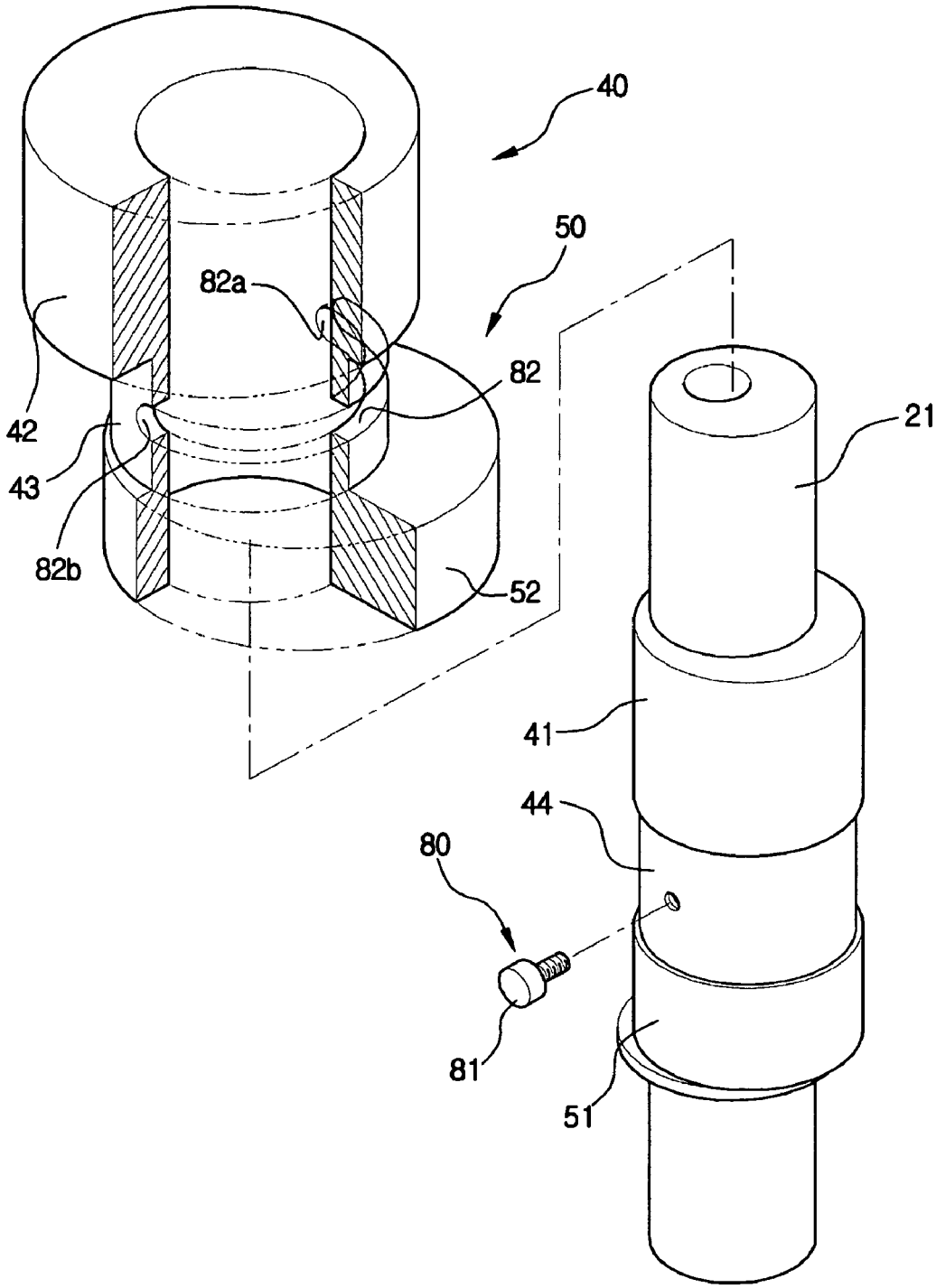
FIG. 2 is a perspective view of eccentric units included in the variable capacity rotary compressor of FIG. 1.

The first and second eccentric units 40 and 50 include first and second eccentric cams 41 and 51, respectively. The first and second eccentric cams 41 and 51 are provided on an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As shown in FIG. 2, the first and second eccentric bushes 42 and 52 are integrally connected to each other by a cylindrical connector 43, and are eccentric from the rotating shaft 21 in opposite directions. Further, the first and second rollers 37 and 38 are rotatably fitted over the first and second eccentric bushes 42 and 52, respectively.

Figure 3:
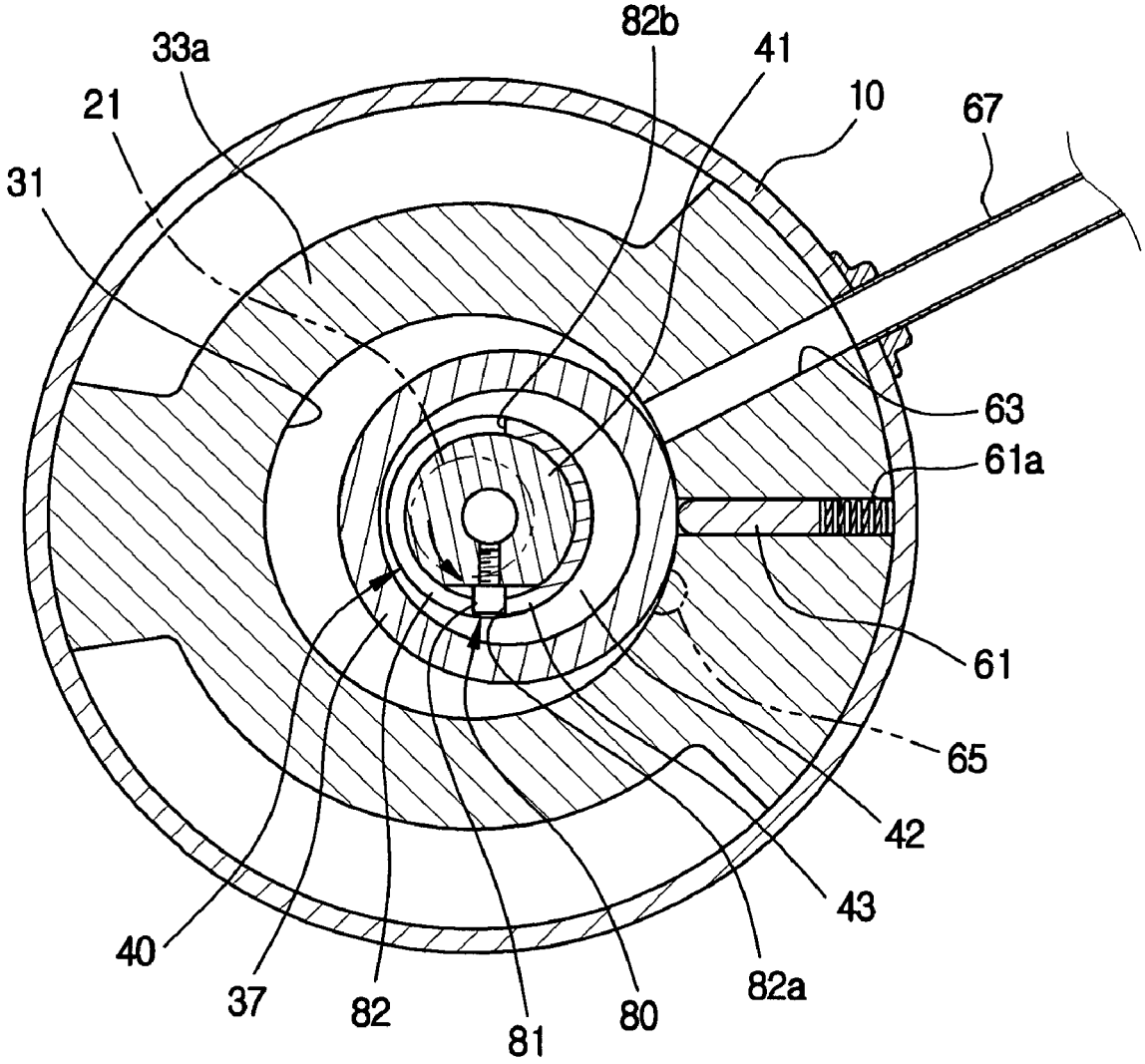
FIG. 3 is a sectional view to show a compression operation of a first compression chamber, when a rotating shaft of the variable capacity rotary compressor of FIG. 1 rotates in a first direction.

As shown in FIGS. 2 and 3, an eccentric part 44 is provided on the outer surface of the rotating shaft 21 between the first and second eccentric cams 41 and 51 to be eccentric from the rotating shaft 21 in the same direction as the first and second eccentric cams 41 and 51. A lock unit 80 is mounted to the eccentric port 44. In this case, the lock 80 makes one of the first and second eccentric bushes 42 and 52 be eccentric from the rotating shaft 21 while releasing a remaining one of the first and second eccentric bushes 42 and 52 from eccentricity from the rotating shaft 21, according to a rotating direction of the rotating shaft 21. The lock 80 includes a locking pin 81 and a locking slot 82. The locking pin 81 is mounted to a surface of the eccentric part 44 in a screw-type fastening method to be projected from the surface of the eccentric part 44. The locking slot 82 is formed around a part of the connecting part 43 which connects the first and second eccentric bushes 42 and 52 to each other. The locking pin 81 engages with the locking slot 82 to make one of the first and second eccentric bushes 42 and 52 be eccentric from the rotating shaft 21 while a remaining one of the first and second eccentric bushes 42 and 52 is released from the eccentricity from the rotating shaft 21, according to the rotating direction of the rotating shaft 21.

When the rotating shaft 21 rotates while the locking pin 81, mounted to the eccentric part 44 of the rotating shaft 21, engages with the locking slot 82 of the connector 43, the locking pin 81 rotates within the locking slot 82 to be locked by either of first and second locking parts 82*a* and 82*b* which are formed at opposite ends of the locking slot 82 to cause the first and second eccentric bushes 42 and 52 to rotate along with the rotating shaft 21. Further, when the locking pin 81 is locked by either of the first and second locking parts 82*a* and 82*b* of the locking slot 82, one of the first and second eccentric bushes 42 and 52 is eccentric from the rotating shaft 21 and a remaining one of the first and second eccentric bushes 42 and 52 is released from the eccentricity from the rotating shaft 21 to execute the compression operation in one of the first and second compression chambers 31 and 32 and to execute an idle operation in a remaining one of the first and second eccentric compression chambers 31 and 32. On the other hand, when the rotating direction of the rotating shaft 21 is changed, the first and second eccentric bushes 42 and 52 are arranged oppositely to the above-mentioned state.

As shown in FIG. 1, the variable capacity rotary compressor according to the present invention also includes a suction path controller 70. The suction path controller 70 controls a refrigerant suction path so that a refrigerant fed from a refrigerant inlet pipe 69 is delivered into either the inlet port 63 of the first compression chamber 31 or the inlet 64 of the second compression chamber 32. Therefore, the refrigerant is delivered into the inlet of the compression chamber where the compression operation is executed.

Figure 7:
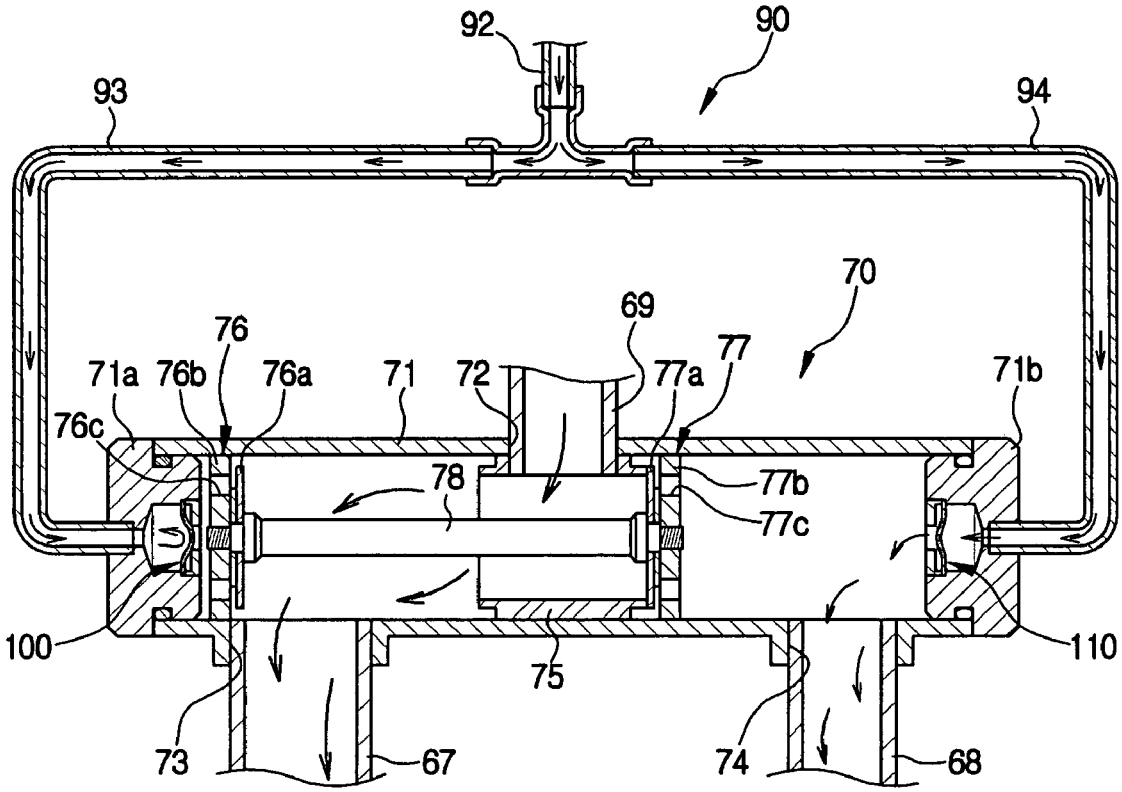
FIG. 7 is a sectional view to show an operation of a suction path controller and a first mode of a high-pressure path, when the compression operation is executed in the first compression chamber of the variable capacity rotary compressor of FIG. 1.
Figure 8:
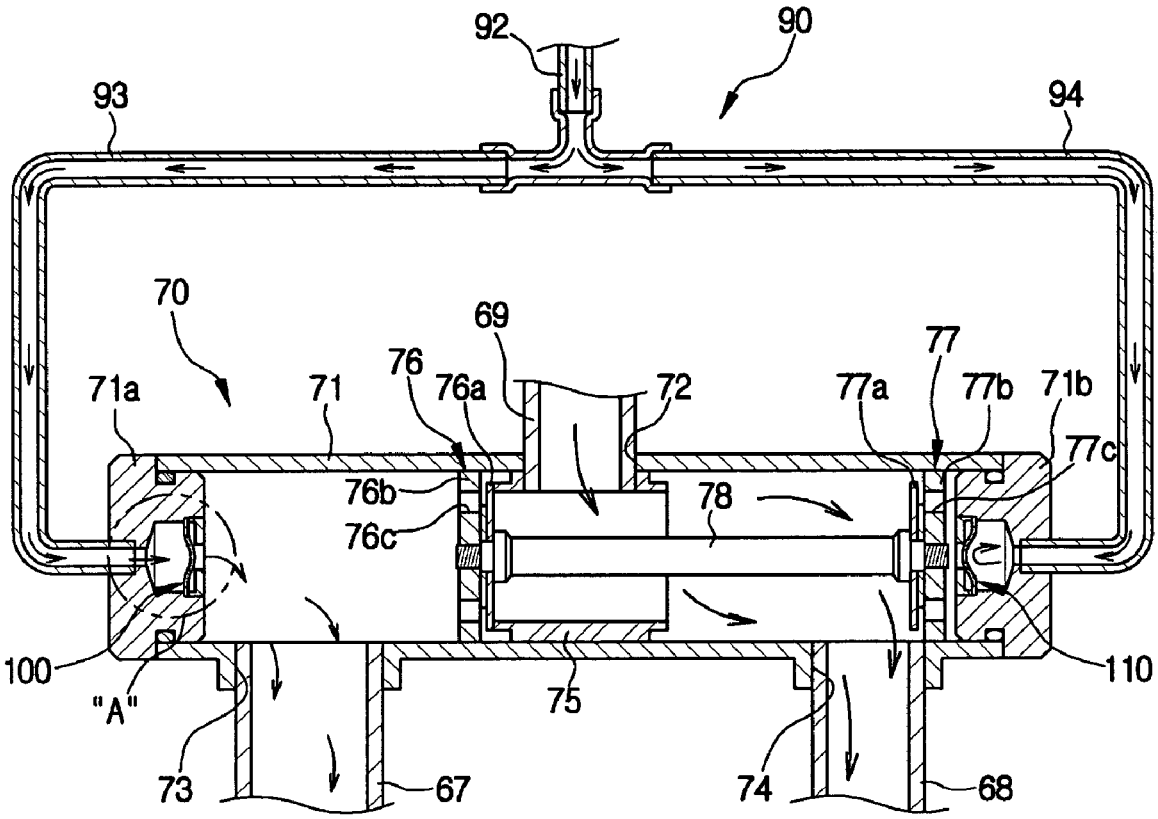
FIG. 8 is a sectional view to show the operation of the suction path controller and a second mode of the high-pressure path, when the compression operation is executed in the second compression chamber of the variable capacity rotary compressor of FIG. 1.

As shown in FIGS. 7 and 8, the path controller 70 includes a hollow body 71. The body 71 has a cylindrical shape of a predetermined length, and is closed at opposite ends thereof by first and second plugs 71*a* and 71*b*. An inlet 72 is formed at a central portion of the body 71 to be connected to the refrigerant inlet pipe 69. First and second outlets 73 and 74 are formed on the body 71 at opposite ends of the inlet 72 to be spaced apart from each other. Two pipes 67 and 68, which are connected to the inlet 63 of the first compression chamber 31 and the inlet 64 of the second compression chamber 32, respectively, are connected to the first and second outlets 73 and 74, respectively.

Further, the suction path controller 70 includes a valve seat 75, first and second valves 76 and 77, and a rod 78. The valve seat 75 has a cylindrical shape which is opened at opposite ends thereof, and is provided in the body 71 to form a step on an internal surface of the body 71. The first and second valves 76 and 77 are provided at both sides in the body 71, and axially reciprocate in the body 71 to open either of the opposite ends of the valve seat 75. The rod 78 connects the first and second valves 76 and 77 to each other so that the first and second valves 76 and 77 move together.

The valve seat 75 has an opening at a center thereof to communicate with the inlet 72. An outer surface of the valve seat 75 is press-fitted into an inner surface of the body 71. The first and second valves 76 and 77 are respectively mounted to opposite ends of the rod 78. The first valve 76 includes a thin valve plate 76*a* and a supporter 76*b*, and the second valve 77 includes a thin valve plate 77*a* and a supporter 77*b*. Each of the valve plates 76*a* and 77*a* contacts with the valve seat 75 to close the refrigerant suction path. The support members 76*b* and 77*b* are mounted to the opposite ends of the rod 78 to support the valve plates 76*a* and 77*a* in the body 71. In this case, each of the supporters 76*b* and 77*b* has an outer diameter to correspond to an inner diameter of the body 71 so as to smoothly reciprocate in the body 71. A plurality of holes 76*c* and 77*c* are formed on the supporters 76*b* and 77*b*, respectively, to allow air ventilation.

As shown in FIG. 1, the variable capacity rotary compressor according to the present invention is constructed so that a pressure of an outlet side of the compressor acts on the inlets 63 and 64 of the first and second compression chambers 31 and 32 where the idle operation is executed to allow an internal pressure of the first and second compression chambers 31 and 32 where the idle operation is executed to be equal to an internal pressure of the hermetic casing 10. According to the present invention, the variable capacity rotary compressor includes a high-pressure pipe 90 and a high-pressure path controller. The high-pressure pipe 90 couples the outlet side of the compressor to the suction path controller 70. The high-pressure path controller controls a high-pressure path so that the high-pressure pipe 90 communicates with the inlets 63 and 64 of the first and second compression chambers 31 and 32 where the idle operation is executed.

The high-pressure pipe 90 includes a connection pipe 92, and first and second pipes 93 and 94. The connection pipe 92 is coupled to a refrigerant outlet pipe 91 of the compressor. The first and second pipes 93 and 94 branch from the connection pipe 92. In this case, an outlet of the first pipe 93 is connected to the first plug 71*a* provided on one of the opposite ends of the body 71, while an outlet of the second pipe 94 is connected to the second plug 71*b* provided on a remaining one of the opposite ends of the body 71.

Figure 9:
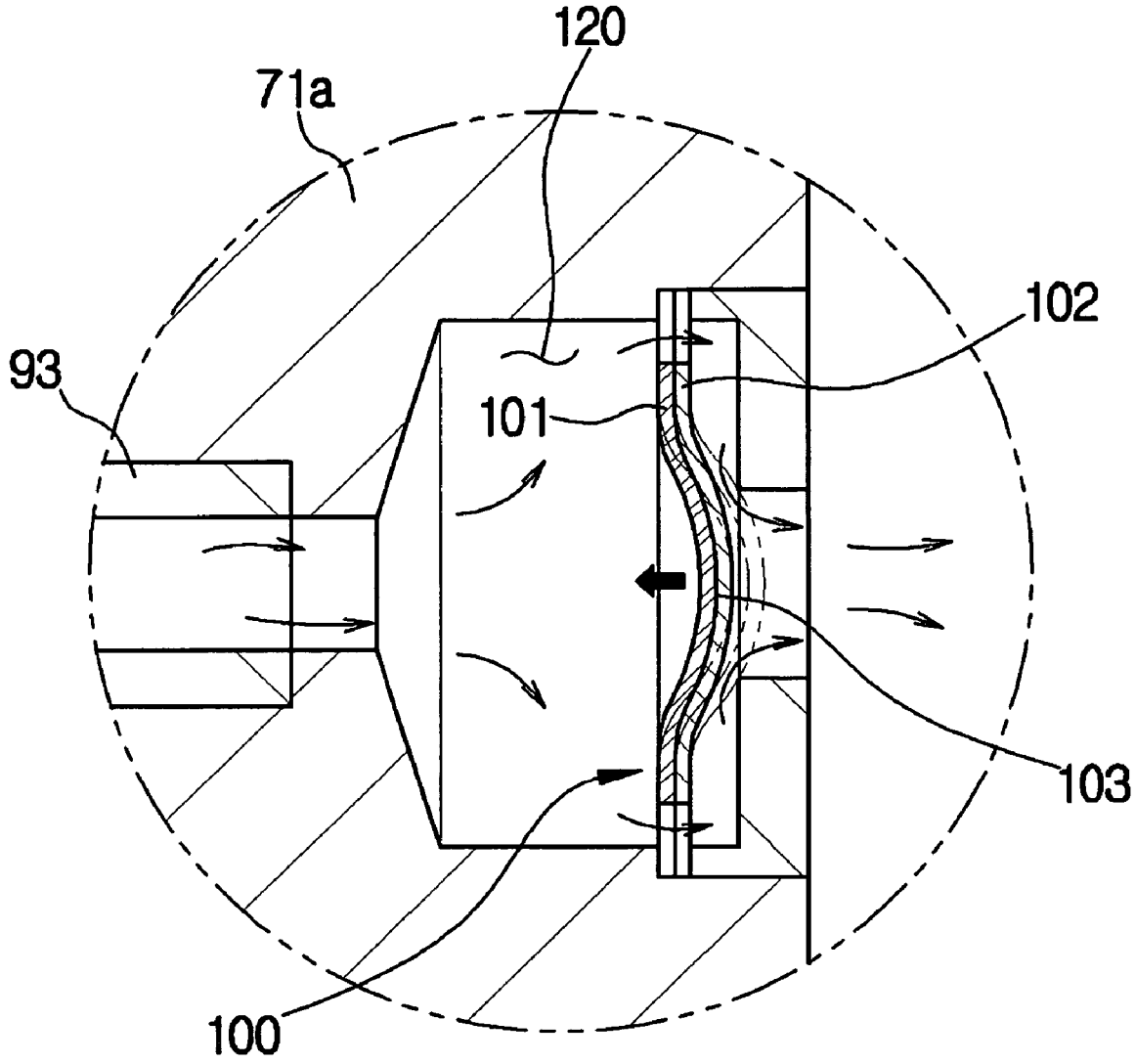
FIG. 9 is an enlarged view of a portion A encircled in FIG. 8, to show a construction of a bimetal valve of the variable capacity rotary compressor of FIG. 1.
Figure 10:
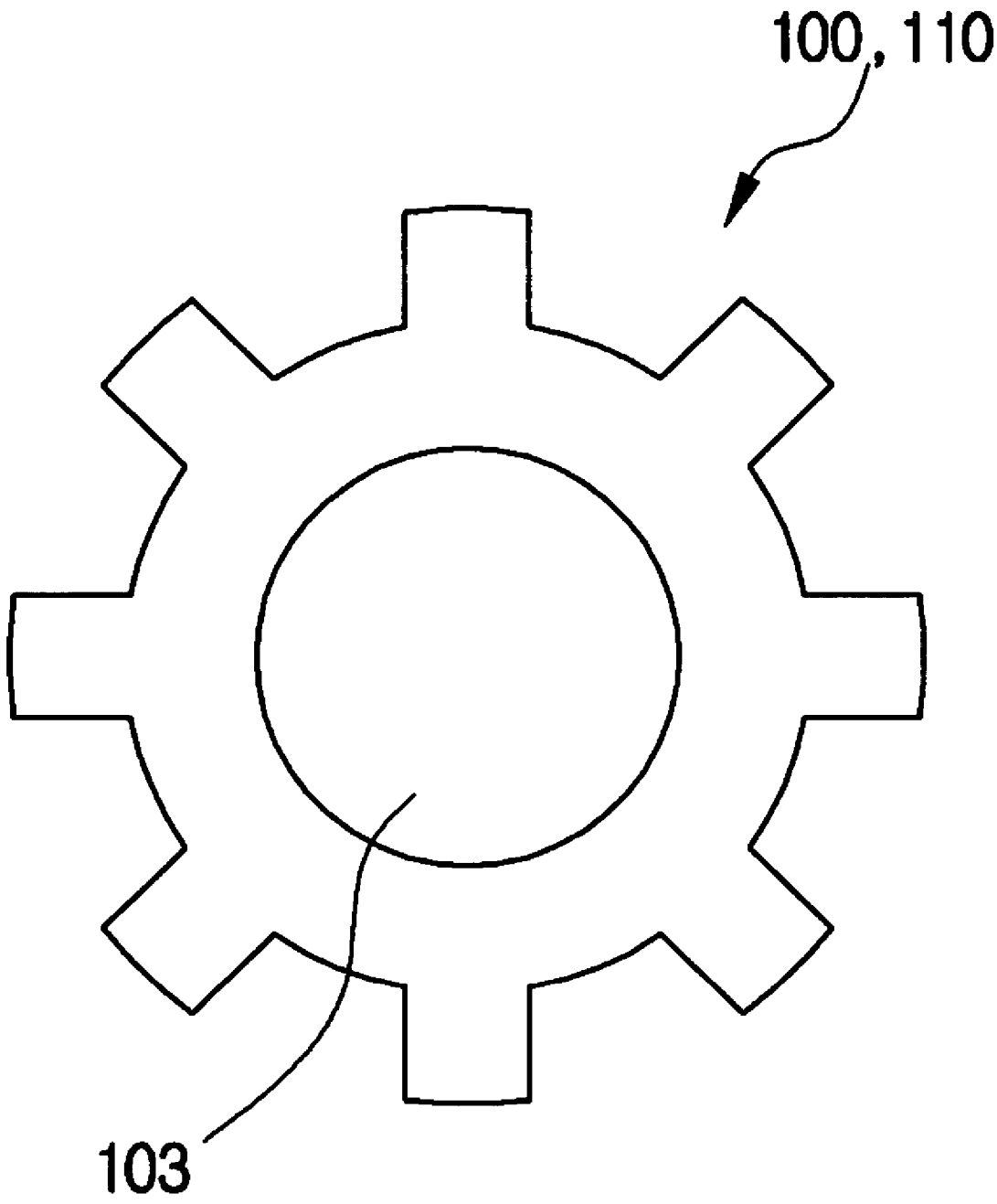
FIG. 10 is a front view of the bimetal valve of the variable capacity rotary compressor of FIG. 1.

Further, as shown in FIGS. 7 and 8, the high-pressure path controller includes first and second bimetal valves 100 and 110. The first and second bimetal valves 100 and 110 are respectively housed in the first and second plugs 71*a* and 71*b* to which the first and second pipes 93 and 94 are respectively connected. According to variance of a temperature, the first bimetal valve 100 opens the outlet of the first pipe 93 or the second bimetal valve 100 opens the outlet of the second pipe 94. The first and second bimetal valves 100 and 110 have a similar construction. FIGS. 9 and 10 show the first bimetal valve 100. The first bimetal valve 100 is housed in a space 120 defined in the first plug 71*a*, and includes first and second metal plates 101 and 102 having different thermal strains. In the first bimetal valve 100, the first metal plate 101 having a higher thermal strain is placed at a position adjacent to the outlet of the first pipe 93, while the second metal plate 102 having a lower thermal strain is placed at a position opposite to the first metal plate 101. Further, the first bimetal valve 100 has, at a center thereof, a dome-shaped valve controller 103 to allow the high-pressure path to be easily opened or closed. The first bimetal valve 100 is fabricated with substantially saw shaped teeth on a circumference thereof to allow a flow of the refrigerant through the spaces between the teeth.

When a temperature around the first and second bimetal valve 100 and 110 rises, the first metal plate 101 is extended further compared to the exterior at the second metal plate 102 while being deformed. As a result the dome-shaped controller 103 opens the high-pressure path. Meanwhile, when a temperature around the first and second valve plate 100 and 110 falls, the first metal plate 101 is contracted further compared to the construction of the second metal plate 102. In this case, the dome-shaped controller 103 is retuned to an original shape to close the high-pressure path. In this way, the outlets of the first and second pipes 93 and 94 are opened or closed. In a detailed description, as shown in FIG. 7, when the refrigerant suction path is formed so that the refrigerant is delivered into the first outlet 73, the temperature around the first bimetal valve 100 falls due to the refrigerant delivered into the first outlet 73. Thus, the first bimetal valve 100 closes the outlet of the first pipe 93. Meanwhile, a portion around the second bimetal valve 110 is affected by only a high-temperature refrigerant of the second pipe 94, and the temperature around the second bimetal valve 110 rises. Thus, the second bimetal valve 110 opens the outlet of the second pipe 94. In a brief description, when the refrigerant suction path is formed so that the refrigerant is delivered into the first outlet 73, the high-pressure path is formed so that the second pipe 94 communicates with the second outlet 74. Thus, the pressure of the outlet side of the compressor acts on the second compression chamber 32 where the idle operation is executed. FIG. 8 shows a case opposite to the case shown in FIG. 7.

The operation of the variable capacity rotary compressor will be described below.

Figure 4:
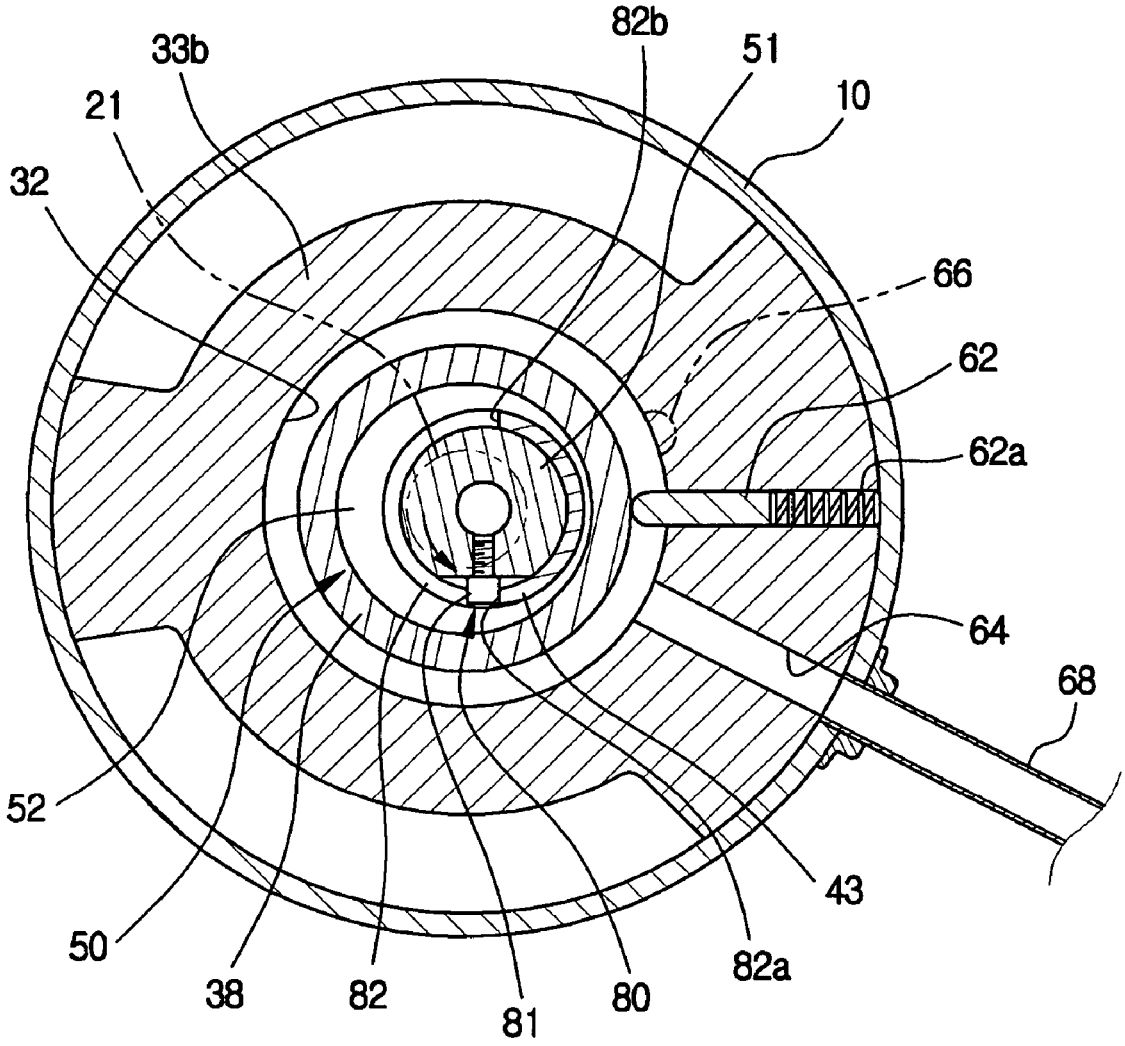
FIG. 4 is a sectional view to show an idle operation of a second compression chamber, when the rotating shaft of the variable capacity rotary compressor of FIG. 1 rotates in the first direction.

As shown in FIG. 3, when the rotating shaft 21 rotates in a first direction, an outer surface of the first eccentric bush 42 in the first compression chamber 31 is eccentric from the rotating shaft 21 and the locking pin 81 is locked by the first locking part 82*a* of the locking slot 82. Thus, the first roller 37 rotates while contacting an inner surface of the first compression chamber 31 to execute the compression operation in the first compression chamber 31. Meanwhile, in the second compression chamber 32 where the second eccentric bush 52 is placed, an outer surface of the second eccentric bush 52, which is eccentric in a direction opposite to the first eccentric bush 42, is concentric with the rotating shaft 21, and the second roller 38 is spaced apart from an inner surface of the second compression chamber 32, as shown in FIG. 4. As a result, idle operation is executed in the second compression chamber 32.

When the compression operation is executed in the first compression chamber 31, the refrigerant is delivered into the inlet 63 of the first compression chamber 31. Thus, the suction path controller 70 controls the path so that the refrigerant is delivered into only the first compression chamber 31. In this case, as shown in FIG. 7, the first and second valves 76 and 77 move toward the first outlet 73 of the body 71 by a suction force which acts on the first outlet 73 to form the refrigerant suction path so that the refrigerant is delivered into the first outlet 73. Meanwhile, because the valve plate 77*a* of the second valve 77 closes an end of the valve seat 75 which communicates with the second outlet 74 of the body 71, the refrigerant is not delivered into the second outlet 74.

At this time, the first bimetal valve 100 is affected by a low-temperature refrigerant flowing into the first outlet 73, so that the outlet of the first pipe 93 is kept closed. On the other hand, because the second bimetal valve 110 is affected by the high-temperature refrigerant of the second pipe 94 and hot air transmitted from the second compression chamber 32 to the second outlet 74, the second bimetal valve 110 is deformed so that the outlet of the second pipe 94 is opened. In this case, the outlet of the second pipe 94 communicates with the second outlet 74, so that the internal pressure of the second compression chamber 32 is equal to the internal pressure of the hermetic casing 10. As a result, the second vane 62 is prevented from pressing the outer surface of the second roller 38, which executes an idle rotation, and oil is prevented from flowing into the second compression chamber 32 to allow the rotating shaft 21 to smoothly rotate.

Figure 5:
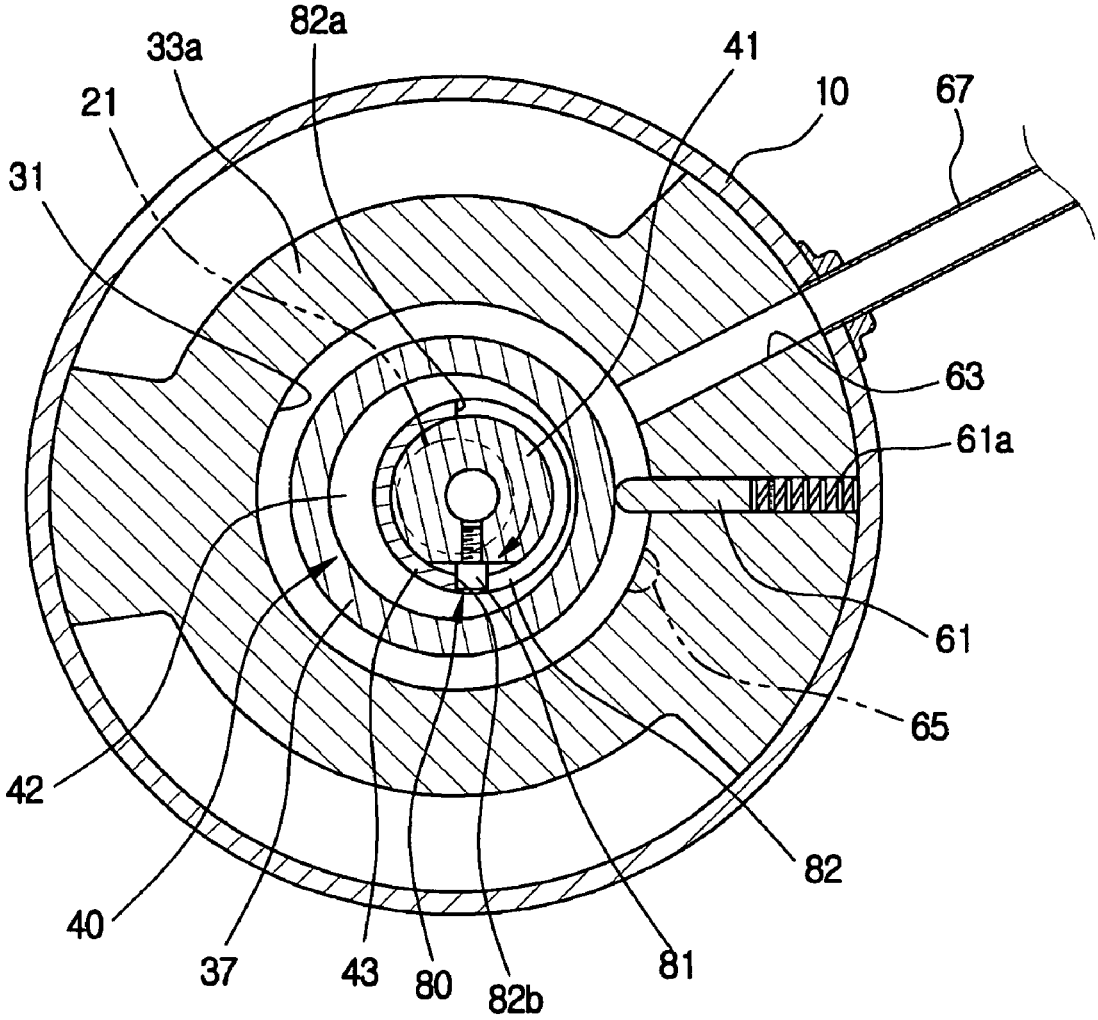
FIG. 5 is a sectional view to show an idle operation of the first compression chamber, when the rotating shaft of the variable capacity rotary compressor of FIG. 1 rotates in a second direction.
Figure 6:
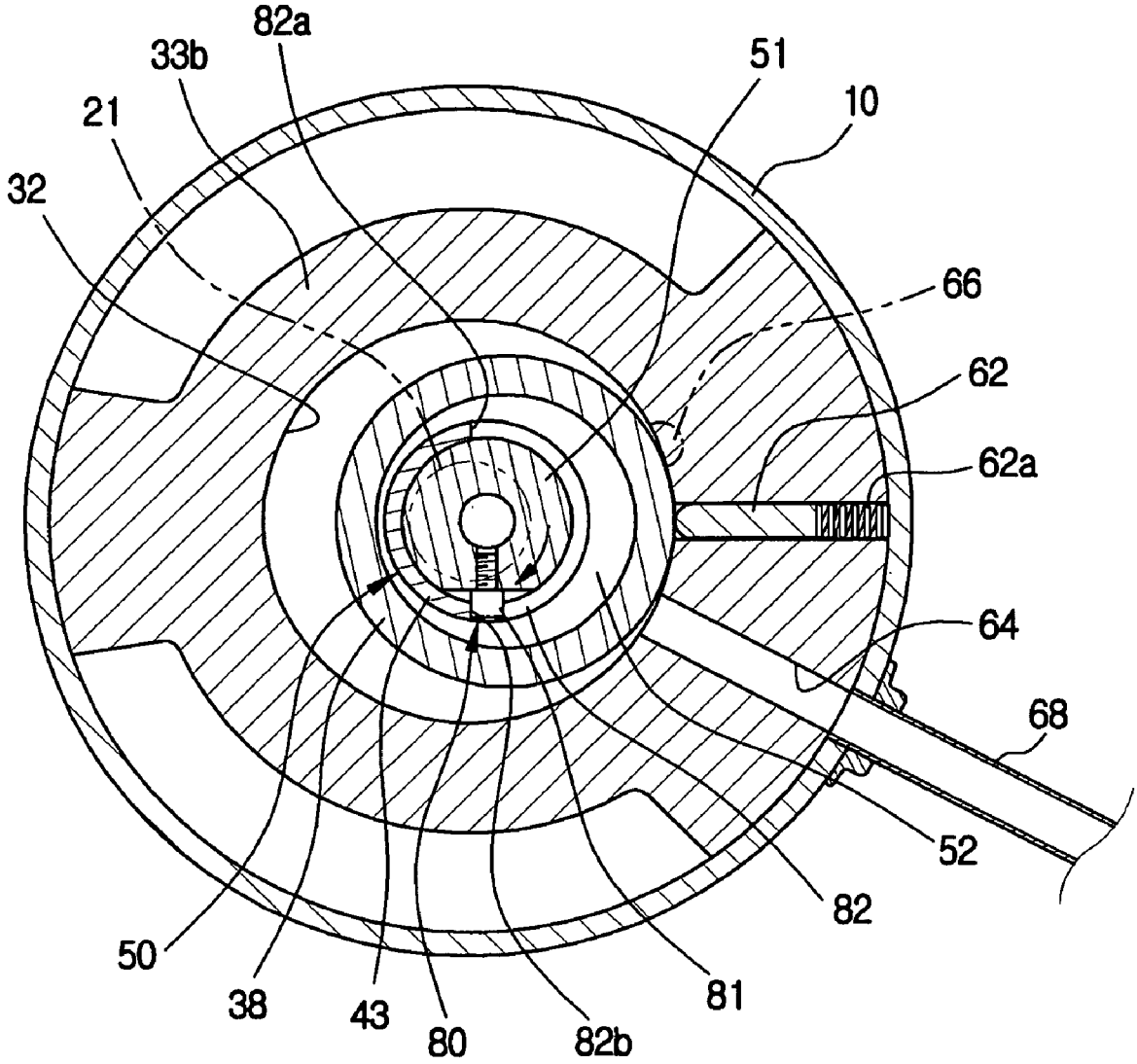
FIG. 6 is a sectional view to show a compression operation of the second compression chamber, when the rotating shaft of the variable capacity rotary compressor of FIG. 1 rotates in the second direction.

Meanwhile, as shown in FIG. 5, when the rotating shaft 21 rotates in a second direction, the outer surface of the first eccentric bush 42 in the first compression chamber 31 is released from the eccentricity from the rotating shaft 21 and the locking pin 81 is locked by the second locking part 82*b* of the locking slot 82. Thus, the first roller 37 rotates while being spaced apart from the inner surface of the first compression chamber 31, so that the idle operation is executed in the first compression chamber 31. Meanwhile, in the second compression chamber 32 where the second eccentric bush 52 is placed, the outer surface of the second eccentric bush 52 is eccentric from the rotating shaft 21, and the second roller 38 rotates while being in contact with the inner surface of the second compression chamber 32, as shown in FIG. 6. Thus, the compression operation is executed in the second compression chamber 32.

When the compression operation is executed in the second compression chamber 32, the refrigerant is delivered into the inlet port 64 of the second compression chamber 32. Thus, the path controller 70 controls the path so that the refrigerant is delivered into only the second compression chamber 32. In this case, as shown in FIG. 8, the first and second valves 76 and 77 move toward the second outlet 74 of the body 71 as a result of a suction force which acts on the second outlet 74 to form the refrigerant suction path so that the refrigerant is delivered into the second outlet 74.

At this time, the second bimetal valve 110 is affected by the low-temperature refrigerant flowing into the second outlet 74, so that the outlet of the second pipe 94 is kept closed. On the other hand, because the first bimetal valve 100 is affected by the high-temperature refrigerant of the first pipe 93 and hot air transmitted from the first compression chamber 31 to the first outlet 73, the first bimetal valve 100 is deformed so that the outlet of the first pipe 93 is opened. In this case, the outlet of the first pipe 93 communicates with the first outlet 73, so that the internal pressure of the first compression chamber 31 is equal to the internal pressure of the hermetic casing 10. As a result, the first vane 61 is prevented from pressing the outer surface of the first roller 37, which executes the idle rotation, and oil is prevented from flowing into the first compression chamber 31 to allow the rotating shaft 21 to smoothly rotate.

As is apparent from the above description, the present invention provides a variable capacity rotary compressor which is constructed so that a refrigerant suction path is controlled by a suction path controller, and a high-pressure path is controlled to cause a high-pressure pipe to communicate with a compression chamber where an idle operation is executed, so that a pressure of an outlet side of the compressor acts on the compression chamber where the idle operation is executed. Thus, there is no pressure difference between an interior of a hermetic casing and an interior of the compression chamber where the idle operation is executed. Thus, a vane in the compression chamber where the idle operation is executed is prevented from pressing an outer surface of a roller in the compression chamber, therefore minimizing a rotating resistance action on the roller, and thereby allowing the compressor to be efficiently operated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, including a hermetic casing, a housing installed in the hermetic casing to define therein first and second compression chambers having different capacities, and a compressing unit placed in the first and second compression chambers, and operated to execute a compression operation in either the first or second compression chamber according to a rotating direction of a rotating shaft which drives the compressing unit, the variable capacity rotary compressor comprising:

a suction path controller to control a refrigerant suction path so that a refrigerant is delivered into an inlet of the first or second compression chamber where the compression operation is executed;

a high-pressure pipe to couple an outlet side of the compressor to the suction path controller; and a high-pressure path controller provided at a predetermined portion of the suction path controller, the high-pressure path controller controlling a high-pressure path so that the high-pressure pipe communicates with the inlet of the first or second compression chamber where an idle operation is executed, according to variance of temperature when the refrigerant suction path is controlled by the suction path controller.

2. The variable capacity rotary compressor according to claim 1, wherein the suction path controller comprises:

a hollow body;

an inlet connected to a refrigerant inlet pipe; and first and second outlets formed on the hollow body at opposite ends of the hollow body to be spaced apart from the inlet of the hollow body, the first and second outlets being respectively connected to the corresponding inlets of the first and second compression chambers;

a valve seat provided in the hollow body to communicate with the inlet of the hollow body of the suction path controller; and first and second valves provided at both sides in the hollow body to axially reciprocate in the hollow body to open either of opposite ends of the valve seat, the first and second valves being connected to each other by a connection rod.

3. The variable capacity rotary compressor according to claim 2, wherein the high-pressure pipe comprises first and second pipe parts which are respectively connected to opposite ends of the hollow body to communicate with the opposite ends of the hollow body.

4. The variable capacity rotary compressor according to claim 3, wherein the high-pressure path controller comprises first and second bimetal valves which are respectively mounted to outlets of the first and second pipes, the first or second bimetal valve opening the outlet of the first or second pipe which has a higher temperature, when the refrigerant suction path is changed by a reciprocating motion of the first and second valves.

5. The variable capacity rotary compressor according to claim 4, wherein each of the first and second bimetal valves comprises:

first and second metal plates having different thermal strains, a dome-shaped valve controller to open the high-pressure path at respective centers thereof; and saw teeth on respective circumferences thereof to allow a flow of the refrigerant.

6. The variable capacity rotary compressor according to claim 4, further comprising:

first and second plugs respectively provided on the opposite ends of the hollow body to close the opposite ends of the hollow body, the first pipe being connected to the first plug and the second pipe being connected to the second plug, wherein the first and second bimetal valves are respectively housed in the high-pressure path defined in each of the first and second plugs.

7. The variable capacity rotary compressor according to claim 6, wherein each of the first and second bimetal valves comprises:

first and second metal plates to have different thermal strains;

a dome-shaped valve control part to open the high-pressure path at respective centers thereof; and saw teeth on respective circumferences thereof to allow a flow of the refrigerant.

8. The variable capacity rotary compressor according to claim 2, wherein each of the first and second valves comprises:

a thin valve plate to come into contact with the valve seat; and a support member to support the thin valve plate.

9. A compressor, including compression chambers, having inlets and outlets on an inlet and outlet side, respectively, to execute compression and idle operations, to allow an internal pressure of the compression chambers, when executing the idle operation, to be equal to a pressure of the outlet side of the compressor, comprising:

a suction path controller, including a refrigerant suction path, to deliver a refrigerant to the inlet of the compression chamber where the compression operation is executed;

a high pressure pipe coupled to an outlet side of the compressor to the suction path controller; and a high pressure controller to control the suction path controller to communicate with the inlets of the compression chambers according to a variance of temperature when the refrigerant suction path is controlled by the suction path controller.

10. The compressor according to claim 9, wherein the suction path controller comprises:

a cylindrical hollow body having open opposite ends; and first and second plugs to close the open opposite ends of the hollow body.

11. The compressor according to claim 10, wherein the suction path controller comprises an inlet at a control portion of the hollow body to supply refrigerant to the suction path controller.

12. The compressor according to claim 11, wherein the suction path controller further comprises:

first and second outlets, which are separated from one another, on the body and opposite to the inlet; and pipes, connected to the inlets of the compression chambers, are connected to the first and second outlets of the suction path controller, respectively.

13. The compressor according to claim 12, wherein the suction path controller comprises:

a cylindrical valve seat, which is opened at opposite ends thereof, to be provided in the hollow body;

first and second valves to reciprocate into and out of the open opposite ends of the body to open and close the open opposite ends of the cylindrical valve seat to change the refrigerant suction path; and a rod to integrally connect the first and second valves.

14. The compressor according to claim 9, further comprising a hermetic casing around the compressor, wherein a pressure of an outlet side of the compressor acts on the inlet of the compression chamber where the idle operation is executed to allow an internal pressure of the compression chamber to be equal to an internal pressure of the hermetic casing.

15. The compressor according to claim 13, wherein the high pressure pipe comprises:

a connection pipe to receive refrigerant from the compressor;

first and second pipes, branching from the connection pipe, having outlets to connect to the first and second plugs of the hollow body, respectively.

16. The compressor according to claim 15, wherein the high pressure controller comprises first and second bimetal valves, housed in the first and second plugs, respectively, to open the outlet of the first pipe and the outlet of the second pipe, respectively.

17. The compressor according to claim 16, wherein the first and second bimetal valves each comprise first and second metal plates having different thermal strains.

18. The compressor according to claim 17, wherein in the first and second bimetal valves, the first metal plates have higher thermal strains than the second metal plates and are placed at positions adjacent to the outlets of the first and second pipes, respectively, while the second metal plates are placed at positions opposite to the first metal plates.

19. The compressor according to claim 18, the first and second bimetal valve each comprise:

a dome at centers thereof to allow the high pressure path to open and close; and substantially saw shaped teeth on circumferences thereof to allow a flow of refrigerant therethrough.

20. The compressor according to claim 19, wherein when a temperature around each of the first and second bimetal valves rises, the first metal plates extend further than the second metal plates, and when a temperature around each of the first and second bimetal valves falls, the first metal plates contract further than the second metal plates.

21. The compressor according to claim 20, wherein when refrigerant is delivered in to either the first or the second outlet, a temperature around the corresponding bimetal valve falls, and the corresponding bimetal valve closes the corresponding pipe, while a temperature around the other bimetal valve rises, and the other bimetal valve opens the other pipe.

* * * * *

UNITED STATES PATENT AND TRADEMARK OFFICE

CERTIFICATE OF CORRECTION

PATENT NO. : 7,153,109 B2
APPLICATION NO. : 10/922943
DATED : December 26, 2006
INVENTOR(S) : Sung Hea Cho et al.

It is certified that error appears in the above-identified patent and that said Letters Patent is hereby corrected as shown below:

Column 12, Line 36, change “in to” --into--.

Signed and Sealed this

Tenth Day of April, 2007

JON W. DUDAS
*Director of the United States Patent and Trademark Office*